US007219462B2

(12) United States Patent
Finn

(10) Patent No.: US 7,219,462 B2
(45) Date of Patent: May 22, 2007

(54) RECEIVER ASSEMBLY FOR FIREARM

(75) Inventor: James Finn, Alpha, IL (US)

(73) Assignee: Rock River Arms, Inc., Colona, IL (US)

( * ) Notice: Subject to any disclaimer, the term of this patent is extended or adjusted under 35 U.S.C. 154(b) by 200 days.

(21) Appl. No.: 10/774,556

(22) Filed: Feb. 9, 2004

(65) Prior Publication Data

US 2005/0183310 A1 Aug. 25, 2005

(51) Int. Cl.
*F41A 9/61* (2006.01)

(52) U.S. Cl. ..... 42/49.01; 42/7; 89/33.1

(58) Field of Classification Search ..... 42/7, 42/49.01; 89/33.1

See application file for complete search history.

(56) References Cited

U.S. PATENT DOCUMENTS 4,058,922 A * 11/1977 Elbe et al. ..... 42/16
4,326,353 A * 4/1982 Ludwig et al. ..... 42/7
4,521,985 A * 6/1985 Smith et al. ..... 42/7
4,579,034 A * 4/1986 Holloway ..... 89/33.1
4,615,134 A * 10/1986 Beretta ..... 42/6
4,709,496 A * 12/1987 Johnson ..... 42/70.11
5,519,954 A * 5/1996 Garrett ..... 42/6
5,588,241 A * 12/1996 Hurley ..... 42/50
6,293,040 B1 * 9/2001 Luth ..... 42/75.01

* cited by examiner

*Primary Examiner*—Michael J. Carone
*Assistant Examiner*—Gabriel J. Klein
(74) *Attorney, Agent, or Firm*—Banner & Witcoff, Ltd.

(57) ABSTRACT

A receiver is configured to receiver a tabbed magazine. The receiver includes a receiver well having a slot configured to accept the tab on the tabbed magazine. In operation, the tabbed magazine can be inserted into the receiver well without having to rotate the tabbed magazine into the receiver well. A magazine catch engages a locking feature in a rib of the tabbed magazine so as to support the tabbed magazine in the receiver well. Once the tabbed magazine is empty, the tabbed magazine can be ejected by pressing a magazine release button without the need to rock the tabbed magazine out of the receiver well. The magazine release button can be configured to allow the user to eject the tabbed magazine by pressing the magazine release button on either side of the receiver. Once a loaded tabbed magazine is placed into the receiver well, the user can press a bolt stop button to release a bolt stop. The bolt stop button can be configured to allow the user to release the bolt stop by pressing the bolt stop button on either side of the receiver.

15 Claims, 14 Drawing Sheets

RECEIVER ASSEMBLY FOR FIREARM

BACKGROUND OF THE INVENTION

1. Field of the Invention

The present invention relates to firearms, more particularly to a receiver assembly for a firearm.

2. Description of Related Art

The use of a receiver on a military style firearm is known. Typically, the receiver is configured to receive a magazine. Differences exist, however, in how the receiver functions and the type of magazine that the receiver can accept.

A major factor affecting the design of the receiver is the type of magazine. High capacity magazines were and are typically manufactured in one of two styles. One style relates to a magazine having a retaining feature and a locking feature. Thus, the first type of magazine can be referred to as a dual feature magazine. Examples of the first type include a tabbed magazine such as might be used on an AK-47 rifle. The other style relates to a magazine that does not use both a retaining and locking feature (i.e. a non-dual featured magazine). Due to differences in the geometry of the two different styles of magazine, two general methods of inserting the magazine into the receiver exist, depending on the style of magazine being used.

A first method of magazine insertion is to insert one end of a tabbed magazine into the receiver. The tab on the tabbed magazine catches on a tab engaging feature in the receiver and the tab is used as a pivot point for rotating the tabbed magazine into the receiver until a magazine catch engages a locking feature of the tabbed magazine. Thus, in the first method the tabbed magazine is held in the receiver well by the tab engaging feature engaging the tab (i.e., the retaining feature), by the magazine catch engaging the locking feature, and by the two walls of the receiver well.

A second method of magazine insertion is to insert a non-tabbed magazine into the receiver by sliding the non-tabbed magazine straight into the receiver well and using a magazine catch to engage a cutout in a wall of the non-tabbed magazine. Unlike the first method, in the second method there is no need to rotate or rock the magazine into the receiver well. Thus, the second method provides a simpler motion for inserting the magazine that can be beneficial when attempting to quickly insert the magazine in the firearm.

Once the magazine is inserted, the firearm can be discharged repeatedly until all the cartridges contained within the magazine are fired. After the last cartridge is fired, a bolt stop is pushed into a blocking position by a cartridge follower and the bolt stop prevents the bolt assembly from moving forward into the battery position. Once a new magazine has been inserted into the receiver, a bolt stop button can be activated. The bolt stop button retracts the bolt stop and allows the bolt assembly to move forward into the battery position, the bolt assembly stripping off a cartridge from the new magazine in the process. It would be preferable to allow ambidextrous operation of the bolt stop button.

Before the new magazine can be inserted, however, the old magazine must be removed. Two general methods exist for removing the magazine from the receiver, depending on whether the magazine is a dual featured magazine such as a tabbed magazine, or is a non-dual featured magazine. With a dual-featured magazine, a magazine release button is activated with the one hand and the dual-featured magazine is rotated out of the receiver with the other hand. Thus, the method of removing a dual-featured magazine requires two hands.

With a non-dual featured magazine, the magazine release button is activated with one hand and the non-dual featured magazine drops free of the receiver. Thus, with a non-dual featured magazine the removal of the empty magazine is a one hand operation. While the release is a one hand operation, the magazine release button is designed to be operated by either the right or left hand, thus limiting certain ergonomic aspects of a firearm, including the ability for the particular firearm to be readily used in either hand. As can be appreciated, however, the method of removing a non-dual featured magazine by simply pressing a button does have certain advantages. For example, the one handed release of a magazine is useful to individuals, whom for medical reasons, have trouble grasping the magazine with the off hand. In addition, the ability to quickly remove an empty magazine can decrease the overall time it takes to go from an empty magazine to a full magazine. Decreasing this transition time can be valuable to members of the armed forces engaged in hostile combat.

As previously mentioned, both tabbed and other style magazines were produced for use in appropriately designed receivers. Due to historical factors, the quantity of high capacity tabbed magazines currently in existence is greater than the quantity of high capacity magazines of other styles. Thus, the cost of high capacity magazines made in styles other then the tabbed style has risen because of the limited supply and the desirability of the magazine quick release feature. The cost of high capacity tabbed magazines, on the other hand, has remained relatively inexpensive. A receiver that accepts the high capacity tabbed magazine could provide the user of the firearm with a decreased operating cost.

BRIEF SUMMARY OF THE INVENTION

In an aspect of the present invention, a receiver well is configured to receive a tabbed magazine, the tabbed magazine having a locking feature. In an exemplary embodiment, the receiver well has a slot for receiving the tab on the tabbed magazine so that the tabbed magazine may be slid directly into the receiver well without the need to rotate the magazine about the tab. In an exemplary embodiment, the internal walls of the receiver well along with the magazine catch are configured to support the magazine when the magazine is in the inserted position. Thus, a tabbed magazine may be inserted into the receiver well without the need to rotate the tabbed magazine about the tab during the insertion.

In an aspect of the present invention, the receiver is equipped with a magazine release button that can be operated from either side of the firearm. Thus, the firearm can be used by someone in either the left or right hand while preserving the ergonomic aspects that allow for ease of activating the magazine release button.

In an aspect of the present invention, a receiver is equipped with a bolt stop release button. In an exemplary embodiment, the bolt stop button can be activated from either side of the firearm by pressing the bolt stop button downward. Thus, the firearm can be used by someone in either the left or right hand while preserving the ergonomic aspects that allow for ease of releasing the bolt stop.

In an aspect of the present invention, a receiver is configured so as to allow one-handed release of a dual-featured magazine. In an exemplary embodiment, a receiver well includes a slot and is configured so that when a magazine catch disengages a locking feature on a tabbed magazine, the magazine drops out of the receiver well. Thus, a dual-featured magazine can be removed from the receiver well with one hand and without the need to rotate the magazine out of the receiver well.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
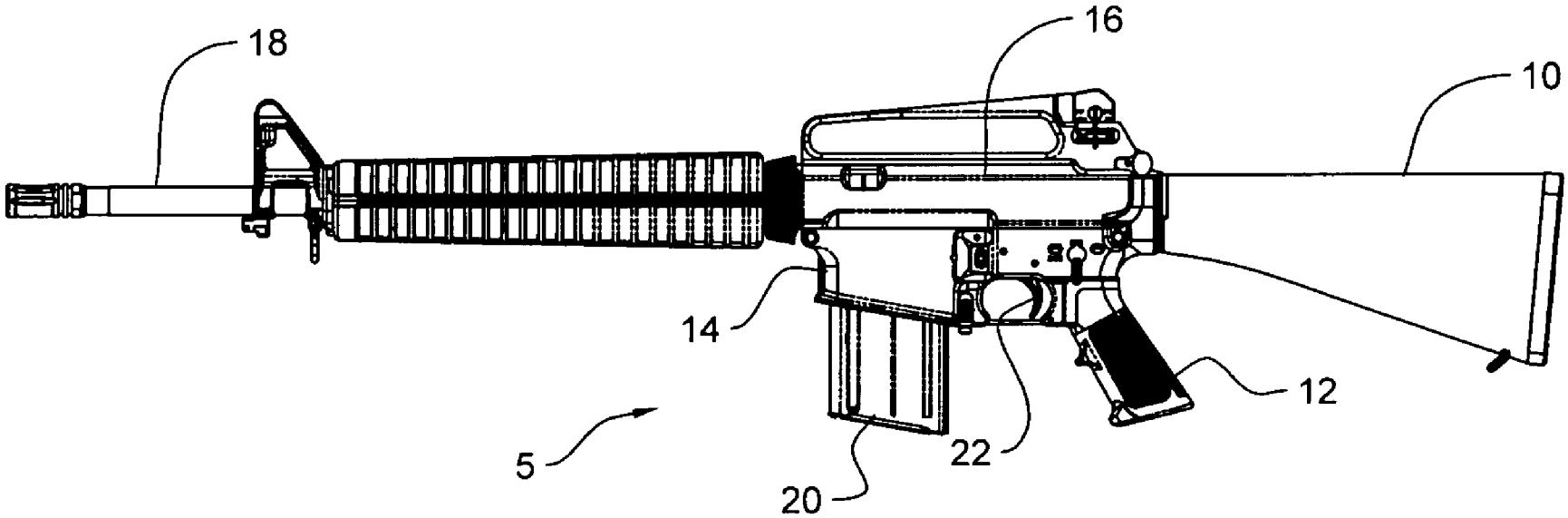
FIG. 1 illustrates an elevation view of an exemplary firearm for use with the teachings of the invention.

FIG. 1 illustrates a side view of an embodiment of a firearm 5. The firearm, in a known configuration, includes a buttstock 10, a grip 12, a receiver 14, a bolt assembly 16 (shown in broken line), and a barrel 18.

In operation, the user can hold the grip 12 in one hand while pressing the buttstock 10 against the users' shoulder. The buttstock 10 and the grip 12 are mounted to the receiver 14. Generally, the receiver 14 is configured to receive the bolt assembly 16 and the barrel 18. In operation, the bolt assembly 16 strips a cartridge from the magazine 20 and moves the cartridge forward into the barrel 18 as the bolt assembly 16 moves toward a battery position. Once the bolt assembly 16 is in the battery position, the user can activate a trigger 22, which can be mounted to the receiver 14. The trigger 22 releases a cocked hammer and the hammer strikes a firing pin. The firing pin moves forward and makes contact with the cartridge. The contact between the firing pin and the cartridge causes the cartridge to fire and the resultant explosion forces a bullet out the end of the barrel 18 along a forward path dependent on the direction the barrel 18 is pointing. The resultant explosion also causes the bolt assembly 16 to recoil in a backward direction opposite of the direction of bullet travel. The movement of the bolt assembly 16 allows the spent cartridge to be ejected. An operation spring (not shown) opposes the backward travel of the bolt assembly 16 and after the operation spring is sufficiently compressed, i.e., the bolt assembly 16 is in a recoiled position, the compressed operation spring moves the bolt assembly 16 forward so that another cartridge can be stripped from the magazine 20 and the bolt assembly 16 can be returned to the battery position.

Figure 2:
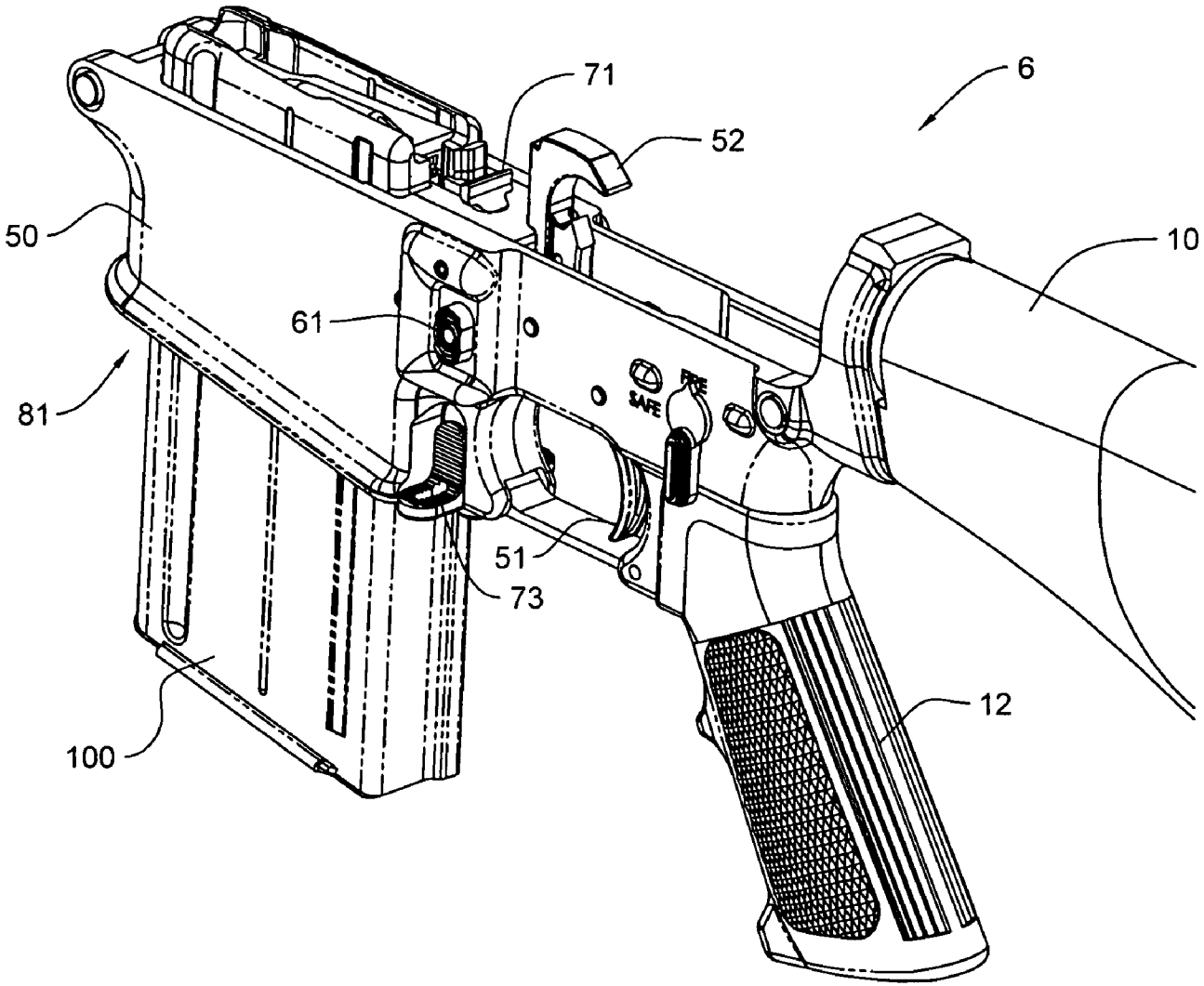
FIG. 2 illustrates an isometric partial view of an exemplary firearm, including the receiver, a portion of the buttstock, a portion of a magazine, and a pistol grip.

As previously described, the receiver as depicted in FIG. 1 can be designed to receive one of two types of magazines. FIG. 2 depicts an isometric partial view of an exemplary embodiment of the firearm 5 illustrated in FIG. 1. The partial firearm, as depicted, comprises a buttstock 10, a grip 12, and a receiver 50 and a tabbed magazine 100. Other components of the firearm 6, including a barrel 18 and a bolt assembly 16, are not shown. A forward direction can be defined as the direction from the buttstock 10 towards the barrel (i.e., the direction the bullet travels in operation). A backwards direction can be defined as the opposite of the forward direction. Right and left directions can be defined with reference to the forward direction.

As depicted in FIG. 2, the receiver 50 includes a trigger 51 and a hammer 52. As depicted, the receiver 50 also includes a magazine release button 61, a bolt stop 71 and a bolt stop release button 73. The tabbed magazine 100 rests inside of the receiver well 81. The magazine release button 61, when depressed, allows the tabbed magazine 100 to be removed from receiver well 81. As depicted, the receiver has a chamfer near the bottom for ease of inserting a magazine into the receiver well.

Figure 3A:
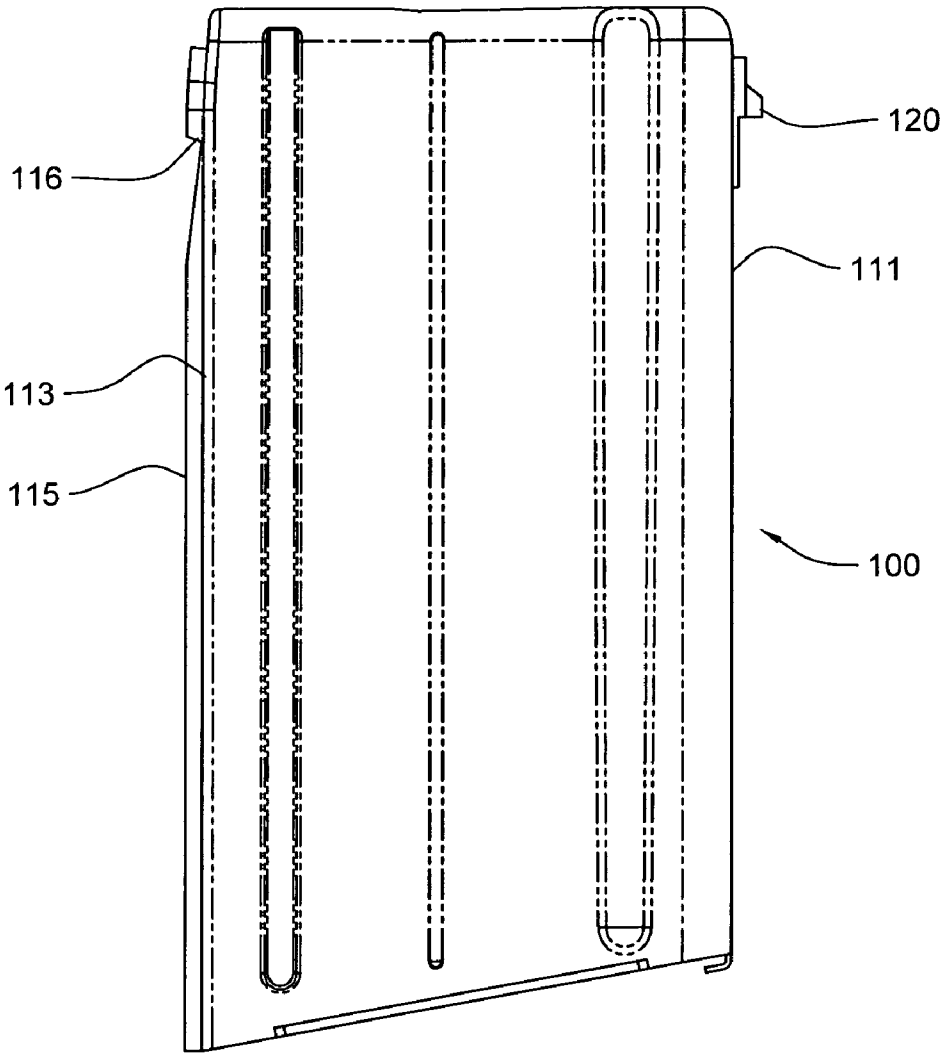
FIG. 3*a* illustrates a partial side view of an exemplary embodiment of a tabbed magazine.

FIG. 3*a* depicts a partial side view of a tabbed magazine 100, which includes a tab 120 located on a first wall 111 of the tabbed magazine 100. Two general patterns of tabbed magazines exist, the English pattern and the Metric pattern. Dimensionally, the two patterns are basically the same except for the size of the tab 120. The English pattern tabbed magazine uses a brazed-on tab 120 where the tab 120 extends about 0.06 inches outwardly from the first wall 111. The metric pattern tabbed magazines uses a formed tab 120 that extends about 0.02 inches outwardly from the first wall 111. Thus, the brazed-on tab 120 extends further from the magazine wall 111 then the formed tab 120. As illustrated in FIG. 3*a*, the tab 120 on the tabbed magazine 100 is brazed-on rather then being formed out of the first wall 111 of the tabbed magazine 100. On a third wall 113, the third wall 113 being opposite the first wall 111 and tab 120, a rib 115 extends along the third wall 113. A locking feature 116 is cut into the rib 115. Locking feature 116 is depicted as a cutout in the rib 115 but could also be designed as a welded on or machined piece fastened to the tabbed magazine 100. In an alternative embodiment, not shown, a dual-featured magazine could have a retaining feature such as a tab, a detent or some other known feature. The magazine would also have a locking feature. Preferably, the retaining feature and the locking feature would be on opposite sides of the magazine so as to provide additional stability.

Figure 3B:
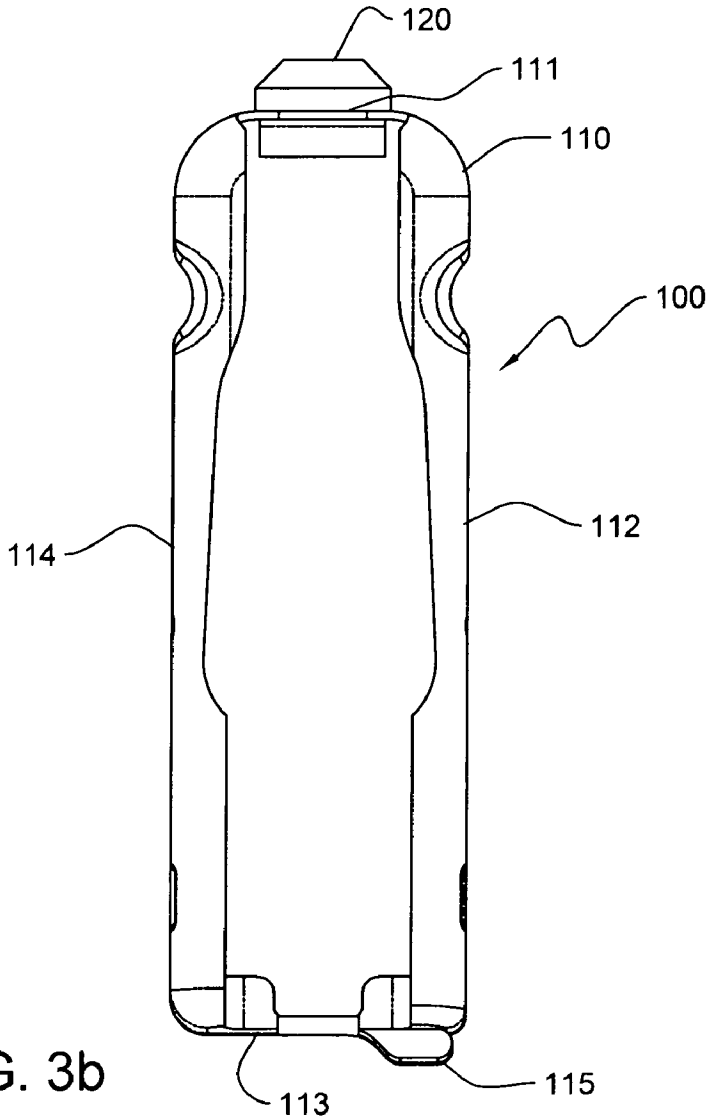
FIG. 3*b* illustrates a partial plan view of the tabbed magazine depicted in FIG. 3*a*.

FIG. 3*b* depicts a plan view of the tabbed magazine 100 depicted in FIG. 3*a*. As depicted, the tabbed magazine 100 includes the first wall 111, a second wall 112, the third wall 113, and a fourth wall 114. The tabbed magazine 100 also includes the rib 115. A magazine profile 110 can be defined by the combination of the outer surfaces of the first wall 111, the second wall 112, the third wall 113, the fourth wall 114, and the rib 115. As can be appreciated, the tab 120 extends outwardly from the first wall 111 beyond the magazine profile 110.

Figure 4A:
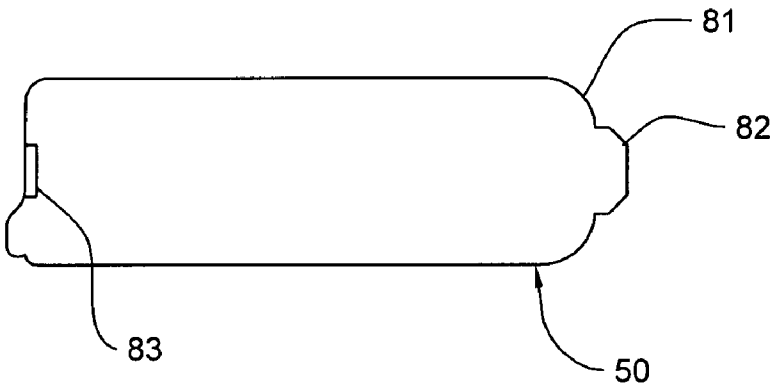
FIG. 4*a* illustrates a partial plan view of an embodiment of the receiver.

FIG. 4*a* illustrates a partial plan view of an exemplary embodiment of receiver 50. The receiver well 81 can be configured to be slightly larger but closely match the physical dimension of the magazine profile 110. The receiver well 81 can include a receiver stop 83. The receiver stop 83 is preferably configured to extend into the receiver well 81 past the outer boundary of the magazine profile 110. In operation, the receiver stop 83 prevents the tabbed magazine 100 from being inserted too far into the receiver well 81. The receiver well 81 further includes a receiver slot 82, the receiver slot 82 configured to allow the tabbed magazine 100, which includes the tab 120, to be inserted straight into the receiver well 81 without the need to rotate the tabbed magazine 100 about the tab 120.

Figure 4B:
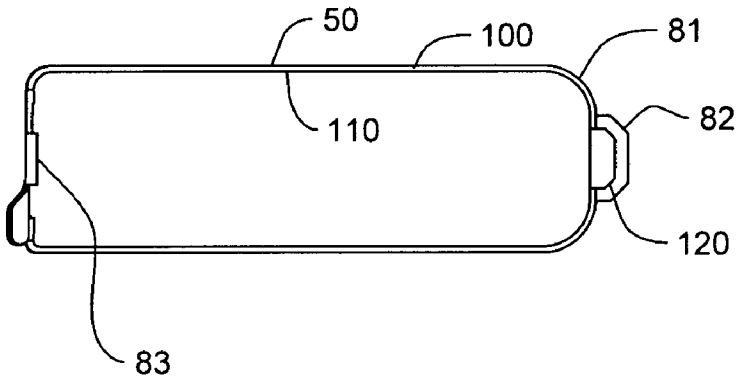
FIG. 4*b* illustrates a partial plan view of the receiver depicted in FIG. 3*a* with the tabbed magazine inserted into the receiver.

FIG. 4*b* illustrates a partial plan view of an exemplary embodiment of the receiver 50 with the tabbed magazine 100 inserted into the receiver well 81. As depicted, the magazine profile 110 interfaces with the receiver well 81, the receiver well 81 being configured to provide surfaces that can support the magazine profile 110. Preferably, the clearance between the receiver well 81 and the tabbed magazine 100 is small so as to minimize movement of the tabbed magazine 100 once it is inserted into the receiver well 81. The close fit between the internal surfaces of the receiver well 81 and the tabbed magazine 100 can control forward, backward, and right/left movement of the tabbed magazine 100. The receiver slot 82 can be configured to allow the tabbed magazine 100 equipped with tab 120 to be inserted into the receiver well 81 while avoiding contact between the tab 120 and the receiver well 81. Thus, as depicted, the tabbed magazine 100, which includes the tab 120, could be slid directly into the receiver well 81 without the need to rotate tabbed magazine 100 about the tab 120. As can be readily appreciated, if the receiver slot 82 is configured to receive the brazed-on tab, the receiver slot 82 will also receive the formed tab, which does not extend outwardly from the magazine 100 as far as the brazed-on tab. It is also preferable to have a chamfer 99 (FIG. 6*a*) on the bottom of the receiver well 81 so as to allow the tabbed magazine 100 to be easily inserted into the receiver well 81.

In an alternative exemplary embodiment, the receiver well 81 could include a rib that could be used, in operation, to control movement of the tabbed magazine 100. In such an example, the rib could be in close proximity or contact with the tabbed magazine 100 once the tabbed magazine 100 was inserted into the receiver well 81. Numerous other geometries of the receiver well 81 exist for supporting the magazine, thus, the described geometries are illustrative.

Figure 5:
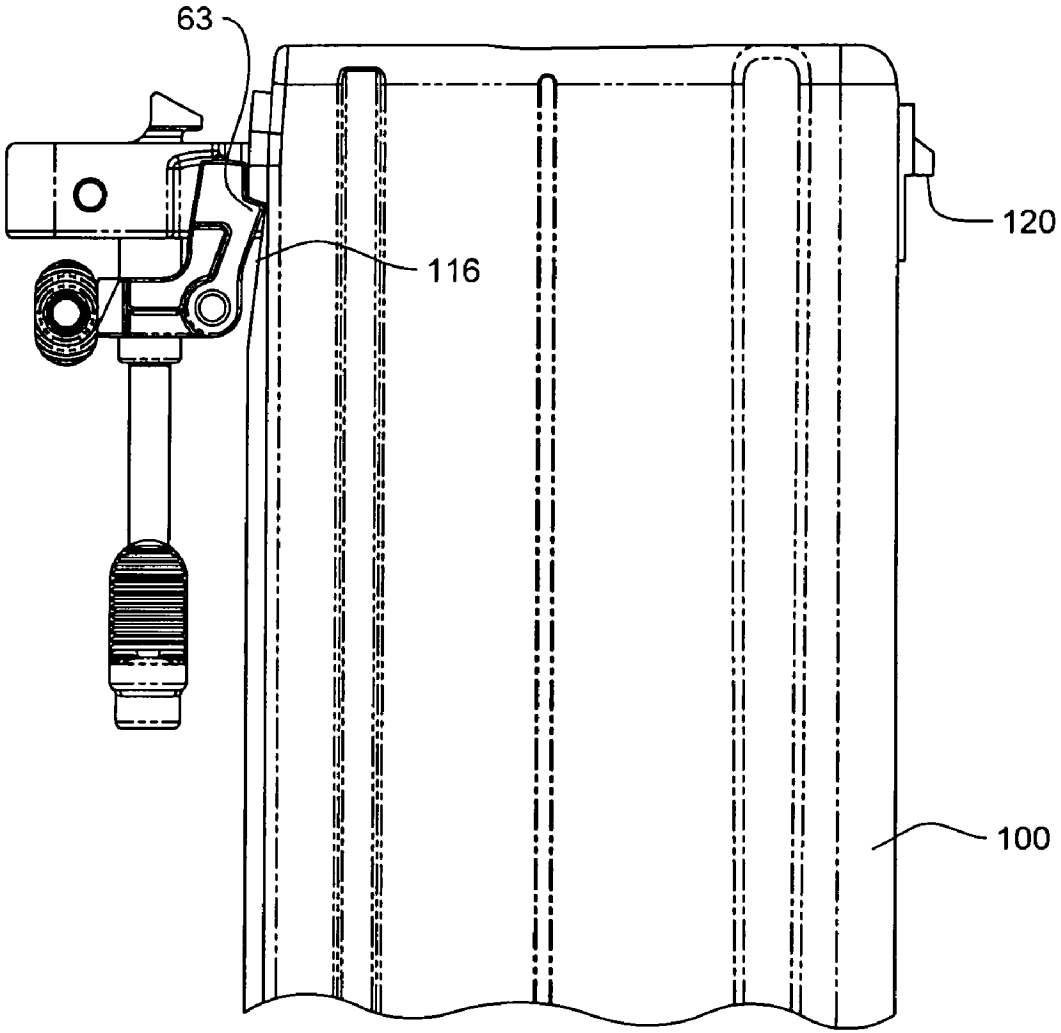
FIG. 5 illustrates a cutaway side view the magazine catch engaging the tabbed receiver.

FIG. 5 illustrates a cutaway side view of the tabbed magazine 100, a magazine catch 63 and and associated components. As depicted, the tabbed magazine 100 is in the inserted position and magazine catch 63 is engaged in the locking feature 116. Thus, the magazine catch 63, when engaged in the locking feature 116, can prevent downward movement of the tabbed magazine 100. Thus, movement of the tabbed magazine 100 can be controlled once the tabbed magazine 100 is inserted into the receiver well 81 by the geometry of the receiver well 81, the receiver stop 83 and the magazine catch 63.

After a loaded tabbed magazine 100 is inserted into the receiver well, the firearm 5 can be fired. As is readily apparent, even high capacity magazines have a limited supply of cartridges. Once all the cartridges are fired and the tabbed magazine 100 is empty, the empty tabbed magazine 100 must be removed before a loaded tabbed magazine 100 can be inserted.

Figure 6A:
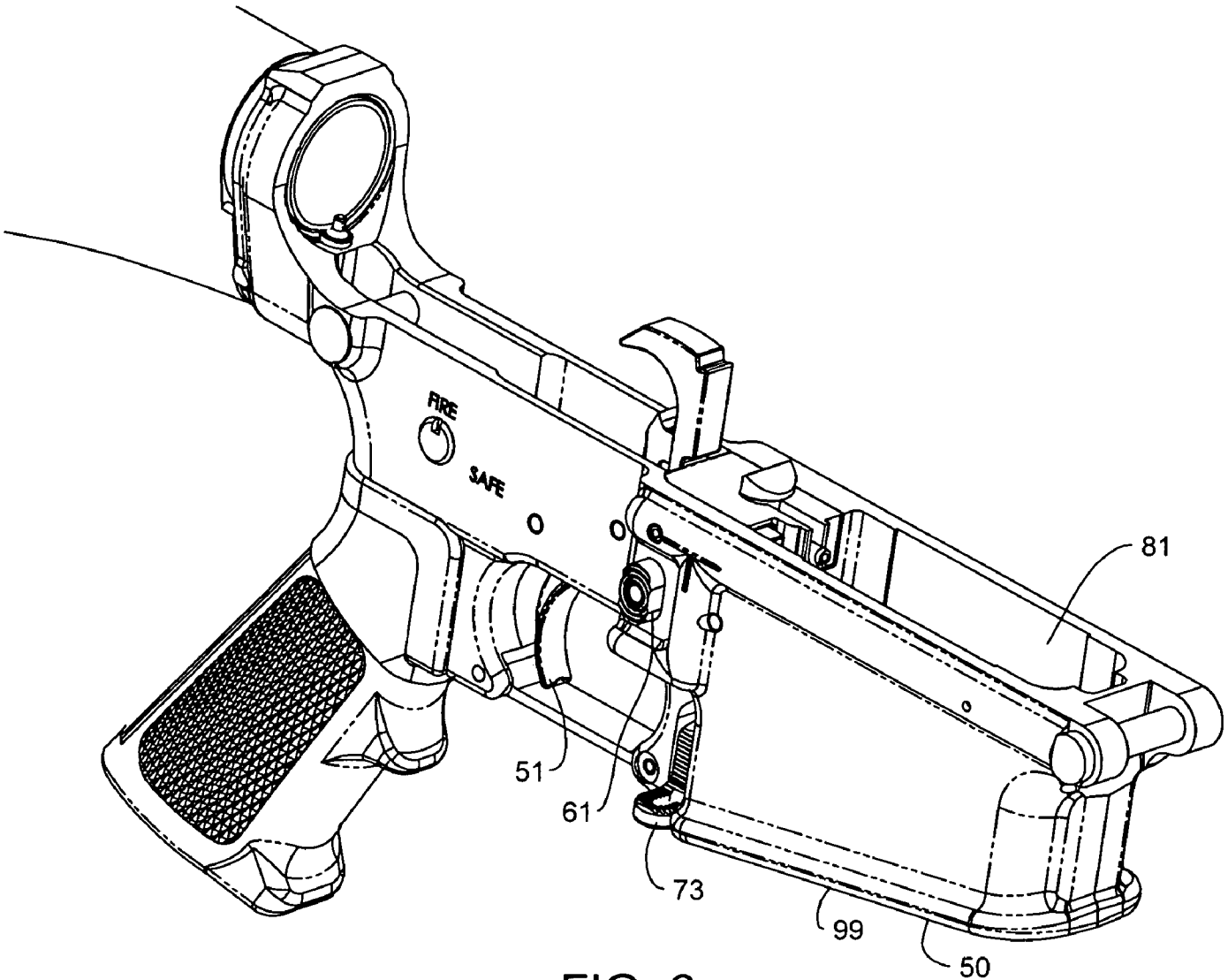
FIG. 6*a* illustrates a partial left isometric view of an exemplary embodiment of the receiver.

FIG. 6*a* illustrates a right isometric view of an exemplary embodiment of the receiver 50. As depicted, magazine release button 61 is located above and forward of trigger 51. Pushing the magazine release button 61 inward would cause the magazine catch 63 to release.

Figure 6B:
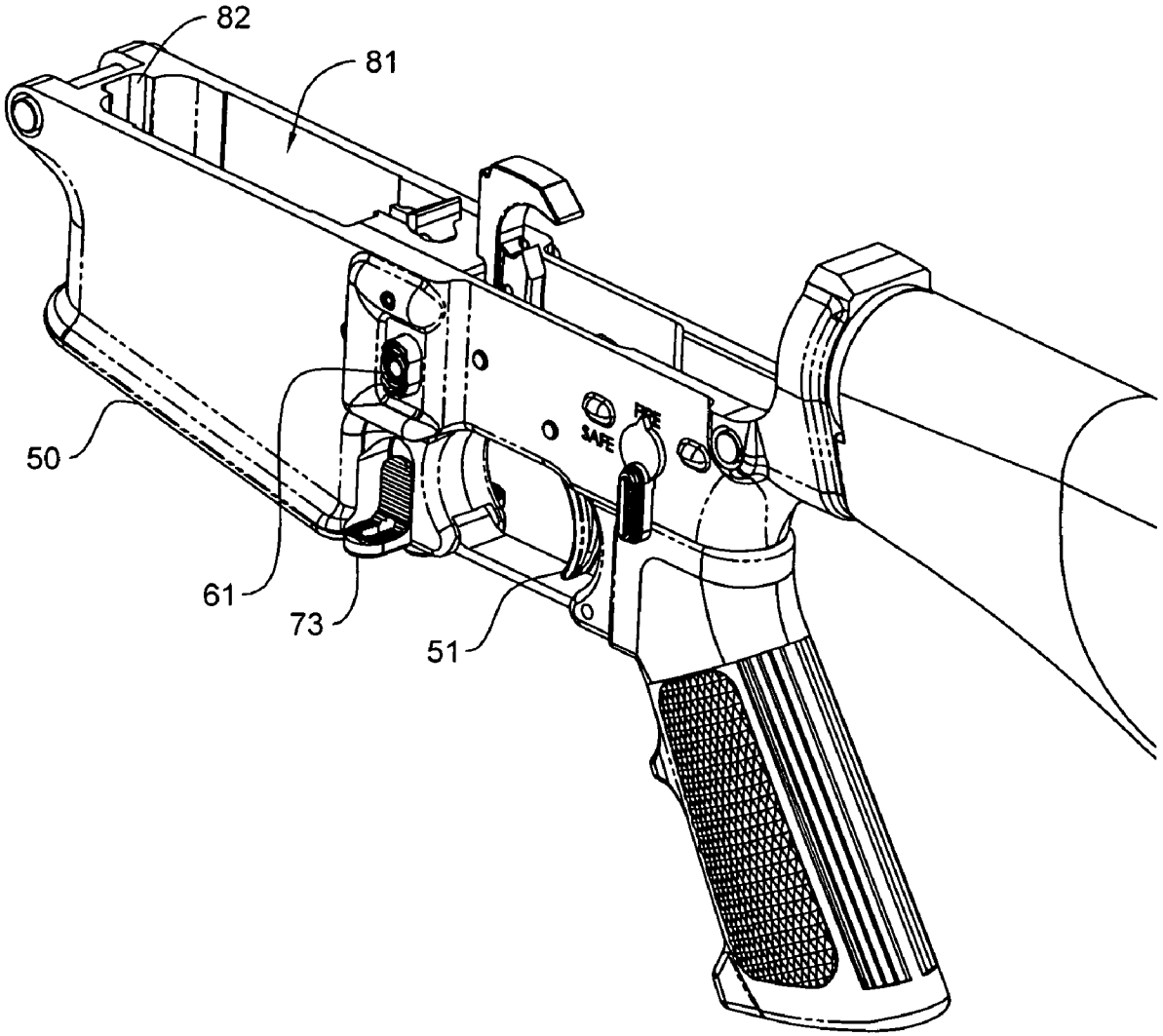
FIG. 6*b* illustrates a partial right isometric view of the receiver depicted in FIG. 6*a*.

FIG. 6*b* illustrates a left isometric view of the embodiment depicted in FIG. 6*a*. As depicted, the magazine release button 61 on the left side is located opposite the magazine release button 61 on the right side. Pushing the magazine release button 61 on the left side inward would also cause the magazine catch 63 to release.

Thus, as depicted in FIGS. 6*a* and 6*b*, the magazine release button 61 can be pushed inward on either side of the receiver 50 so as to release the magazine catch 63 and therefore provide an ambidextrous release feature. Regardless of whether the magazine release button 61 is pressed on the left or the right side of the receiver, pushing the magazine release button 61 allows a dual-featured magazine, such as the tabbed magazine 100 to be removed from the receiver 50. In an exemplary embodiment, pushing the magazine release button 61 causes the tabbed magazine 100 to drop out of the receiver. Thus, in an exemplary embodiment, the dual-featured magazine can be removed with one hand. As can be appreciated, the magazine release button 61 can be depressed with the trigger finger of the user. Thus, as depicted, the ambidextrous nature of the magazine release button 61 can allow the user of the firearm to hold the firearm in either hand.

FIGS. 6*a* and 6*b* also depict an exemplary embodiment of a bolt stop button 73 (discuss below) located on the right side and the left side of the receiver 50. Thus, in an exemplary embodiment of the present invention, the magazine release button 61 and the bolt stop button 73 are located on both the left side and the right side of the receiver 50 and thus the firearm. As depicted, the inclusion of the bolt stop button 73 and the magazine release button 61 on both the left and the right side provides a receiver 50 suited for use in either hand, enhancing the ergonomics of the firearm.

Figure 7:
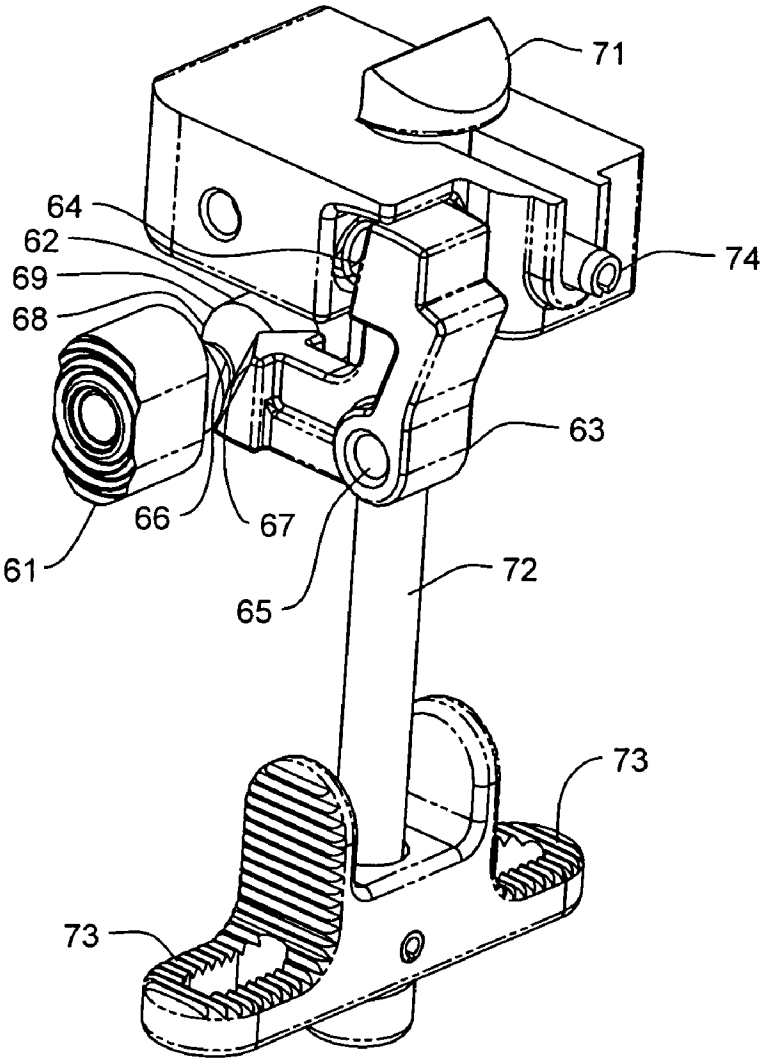
FIG. 7 illustrates an isometric view of an exemplary magazine catch and associate components.

FIG. 7 illustrates an isometric view of the magazine catch 63 and associated components. Magazine catch 63 is mounted to the receiver 50 via a magazine catch pin 65. Magazine catch spring 64 is mounted so as to bias the magazine catch 63 to rotate about the magazine catch pin 65 toward a magazine release pin 62 and into the receiver well 81. As depicted, magazine release button 61 is mounted to magazine release pin 62. Depressing the magazine release button 61 causes the magazine release pin 62 to translate. The magazine catch pin 62 has a release pin v-notch 66 that interfaces with the magazine catch 63. The release pin v-notch 66 has a first smaller diameter 68 and a second larger diameter 69 on both the left and right side of the first smaller diameter. The magazine catch 63 is biased toward the release pin v-notch 66 by a magazine spring 64 so that the magazine catch 63 exerts a force on the magazine release pin 62. During translation of the magazine release pin 62, the magazine catch 63 moves from the first smaller diameter to the second larger diameter. Thus, translation of the magazine release pin 62 causes the magazine catch 63 to rotate about the magazine catch pin 65, the rotation opposed by the magazine catch spring 64. The rotation of the magazine catch 63 causes the magazine catch 63 to disengage from the locking feature 116 on the tabbed magazine 100. Once the user releases the magazine release button 61, the force exerted on magazine release pin 62 by the magazine catch 63, the magazine catch 63 being biased by the magazine catch spring 64, causes the magazine release pin 62 to translate so that the magazine catch 63 can return from the second larger diameter 69 to the first smaller diameter 68 of the v-notch pin 66.

As depicted, the release pin v-notch 66 interfaces with a corresponding surface 67 on the magazine catch 63. When the surface 67 engages the first smaller diameter 68 the magazine catch 63 is in the engaged position. When the surface 67 engages the second larger diameter 69 this position corresponds to the magazine catch 63 being in the disengaged position.

Also depicted in FIG. 7 is a bolt stop 71, a bolt stop pin 74, a bolt stop member 72, and the bolt stop button 73. These components will be discussed in greater detail below.

The insertion of a magazine can cause the magazine catch 63 to rotate about the magazine catch pin 65 away from the magazine release pin 62 until the magazine is inserted far enough into the receiver well 81 so that the magazine catch 63 can engage the locking feature 116. Thus, upon full insertion of the tabbed magazine 100, the magazine catch spring 64 will force the magazine catch 63 back to the engaged position.

Figure 8B:
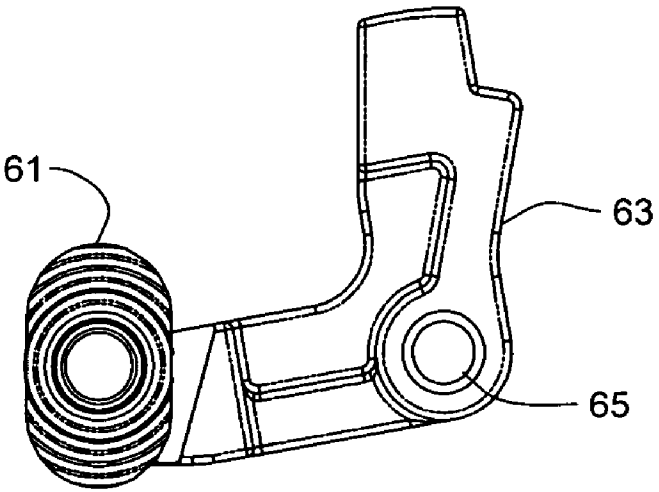
FIG. 8*b* illustrates a side view of the magazine release system depicted in FIG. 8*a* with the magazine release button activated.
Figure 8A:
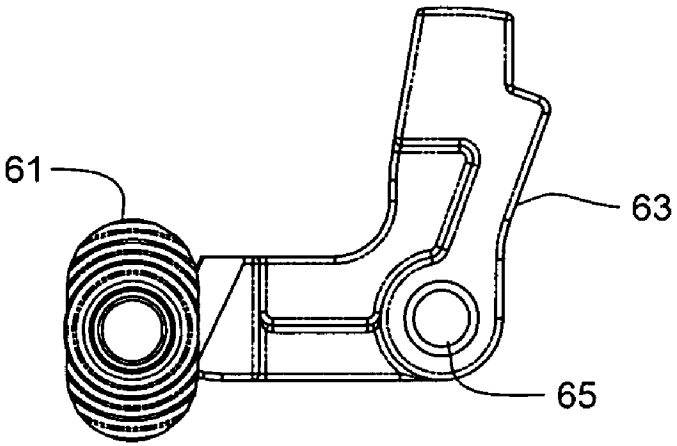
FIG. 8*a* illustrates a side view of an exemplary embodiment the magazine release system, with the magazine release button not activated.

FIG. 8*a* illustrates a side view of an exemplary embodiment of the magazine release system, including the magazine release button 61, the magazine catch 63 and the magazine catch pin 65. As depicted in FIG. 8*a*, the magazine release button 61 is not depressed and magazine catch 63 is in the engaged position. In operation, the magazine catch 63 supports a magazine by engaging with the locking feature 116 when the magazine is inserted.

FIG. 8*b* illustrates a side view of the embodiment depicted in FIG. 8*a*. As depicted, the magazine release button 61 is depressed. Depressing the magazine release button 61 causes the magazine catch 63 to rotate about the magazine catch pin 65 away from the engaged position. In operation, this rotation can disengage the magazine catch 63 from the locking feature 116 so as to allow the dual-featured magazine to drop free of the receiver 50.

Figure 9B:
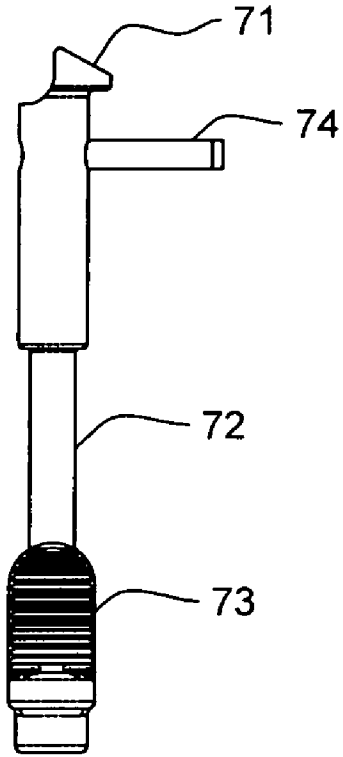
FIG. 9*b* illustrates a side view of the bolt system depicted in FIG. 10*a*.
Figure 9A:
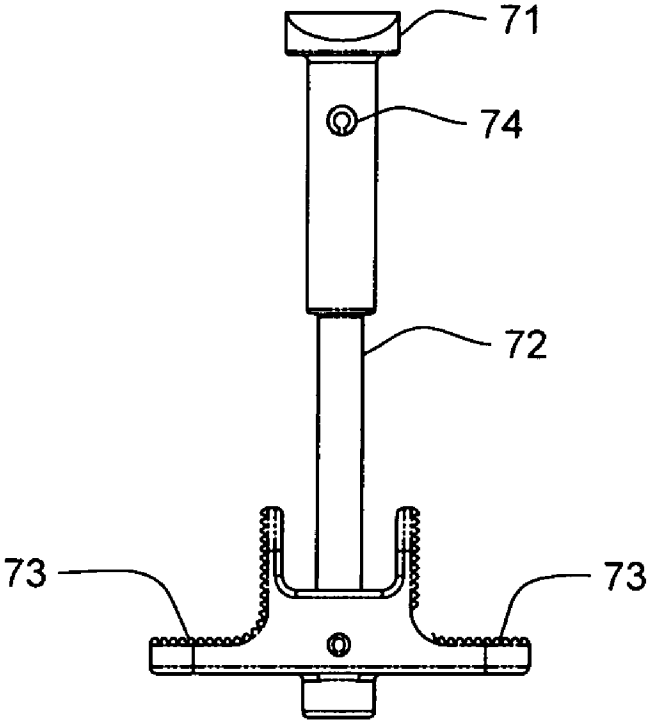
FIG. 9*a* illustrates a front view of an exemplary bolt stop system.

FIG. 9*a* illustrates a front view of the bolt stop 71 and associated components. In operation, bolt stop member 72 can be translatably mounted to the receiver 50 so that bolt stop member 72 can move along its longitudinal axis. As depicted, bolt stop button 73 is mounted on both sides of bolt stop member 72. Bolt stop member 72 is connected to bolt stop 71. In an exemplary embodiment, bolt stop button 73 is located on both sides of the receiver so as to provide an improvement over existing firearms that could not provide such an ergonomic feature. As can be readily appreciated, having the bolt stop button 73 on both sides of the receiver allows the same firearm to be more readily operated in both the left hand and the right hand.

FIG. 9*b* illustrates a side view of the embodiment depicted in FIG. 9*a*. As depicted, bolt stop pin 74 is mounted to bolt stop member 72. Thus, as depicted, upward vertical movement of the bolt stop pin 74 causes the bolt stop member 72 to translate in an upward vertical direction, where the upward vertical movement of bolt stop member 72 causes the bolt stop 71 to move from a non-blocking to a blocking position. Likewise, downward translation of the bolt stop member 72, by pressing down on the bolt stop button 73 causes the bolt stop 71 to move toward a non-blocking position. In operation, a spring can be used to bias the bolt stop 71 towards the non-blocking position.

Figure 10A:
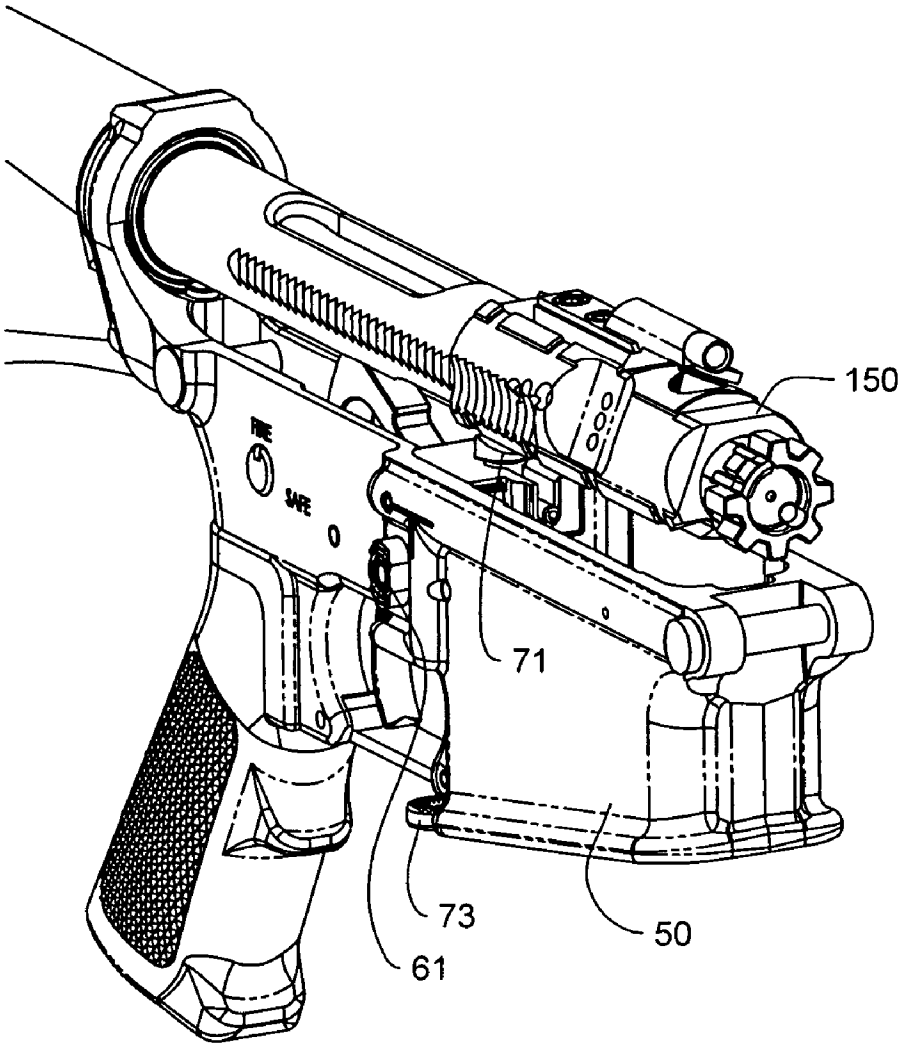
FIG. 10*a* illustrates a partial isometric view of an exemplary embodiment of the receiver after the last cartridge has been removed from the magazine but the bolt assembly is still in the battery position.

FIG. 10*a* illustrates a partial isometric view of an exemplary embodiment of receiver 50 after the last cartridge has been removed from the tabbed magazine 100 with a bolt assembly 150 in a battery position. In operation, a cartridge follower presses upward against the bolt stop pin 74 (not shown) when the last cartridge is removed from the magazine. As described in FIGS. 9*a* and 9*b*, the bolt stop pin 74 is mounted to the bolt stop member 72. Bolt stop member 72 connects bolt stop 71 to bolt stop button 73. Therefore, by pushing upward on bolt stop pin 74, the cartridge follower exerts an upward force on the bolt stop 71. Movement of the bolt stop 71 is inhibited by the presence of a bolt assembly 150 in a battery position. Thus, when the bolt assembly 150 is in the battery position, as shown in FIG. 10*a*, the bolt assembly 150 is in the way of upward movement by the bolt stop 71. Once the last cartridge is fired, the bolt assembly moves from the battery position toward a recoiled position.

Figure 10B:
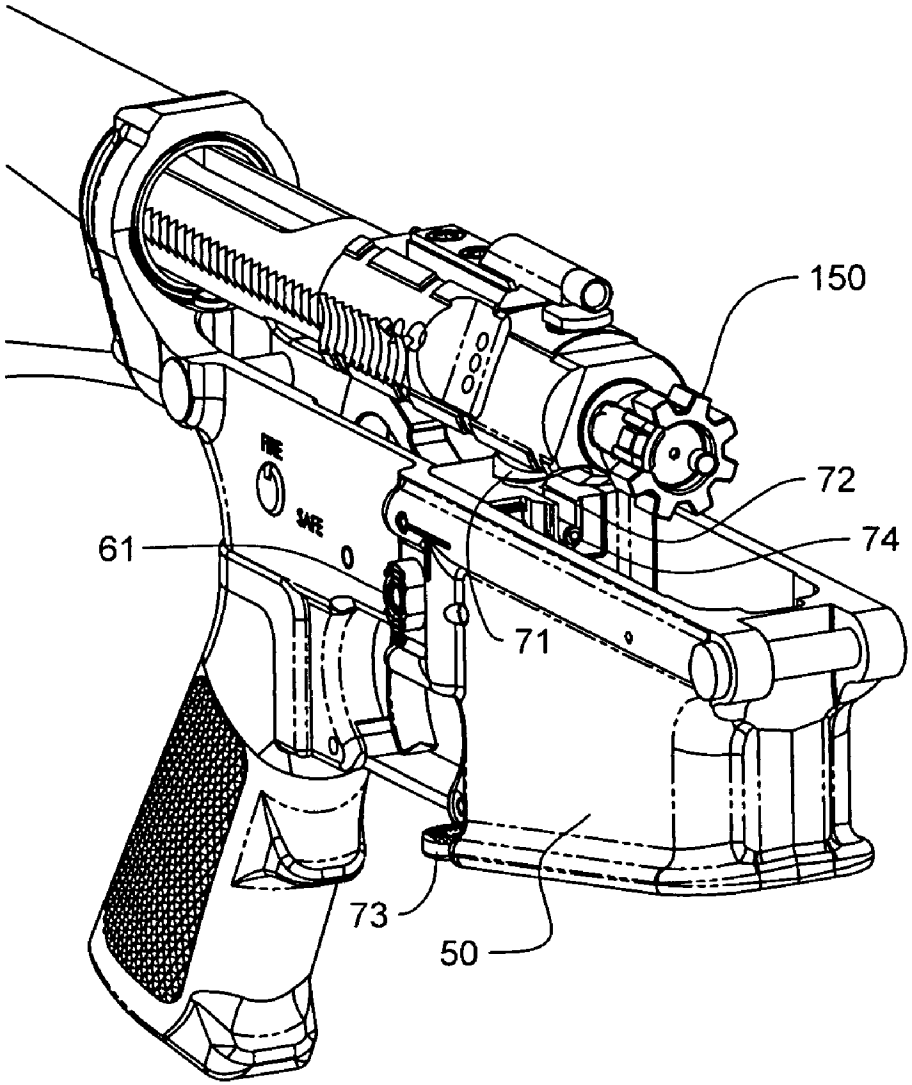
FIG. 10*b* illustrates a partial isometric view of an exemplary embodiment of the receiver with the bolt assembly moving toward the recoiled position.

FIG. 10*b* illustrates a partial isometric view of the embodiment shown in FIG. 10*a*, with the bolt assembly 150 moving towards the recoiled position. As is readily apparent, once the bolt assembly 150 moves far enough toward the recoiled position, the bolt stop 71 can move in an upward direction. The force exerted on the bolt stop pin 74 by the cartridge follower will direct the bolt stop member 72, the bolt stop button 73, and the bolt stop 71 upward. Thus, the bolt stop 71 can travel upward from a non-blocking position to a blocking position. As previously discussed, the operation spring biasing the bolt assembly 150 toward the battery position compresses as the bolt assembly 150 moves toward the recoiled position. Once the bolt assembly 150 reaches the recoiled position, the compressed operation spring directs the bolt assembly 150 back towards the battery position.

Figure 10C:
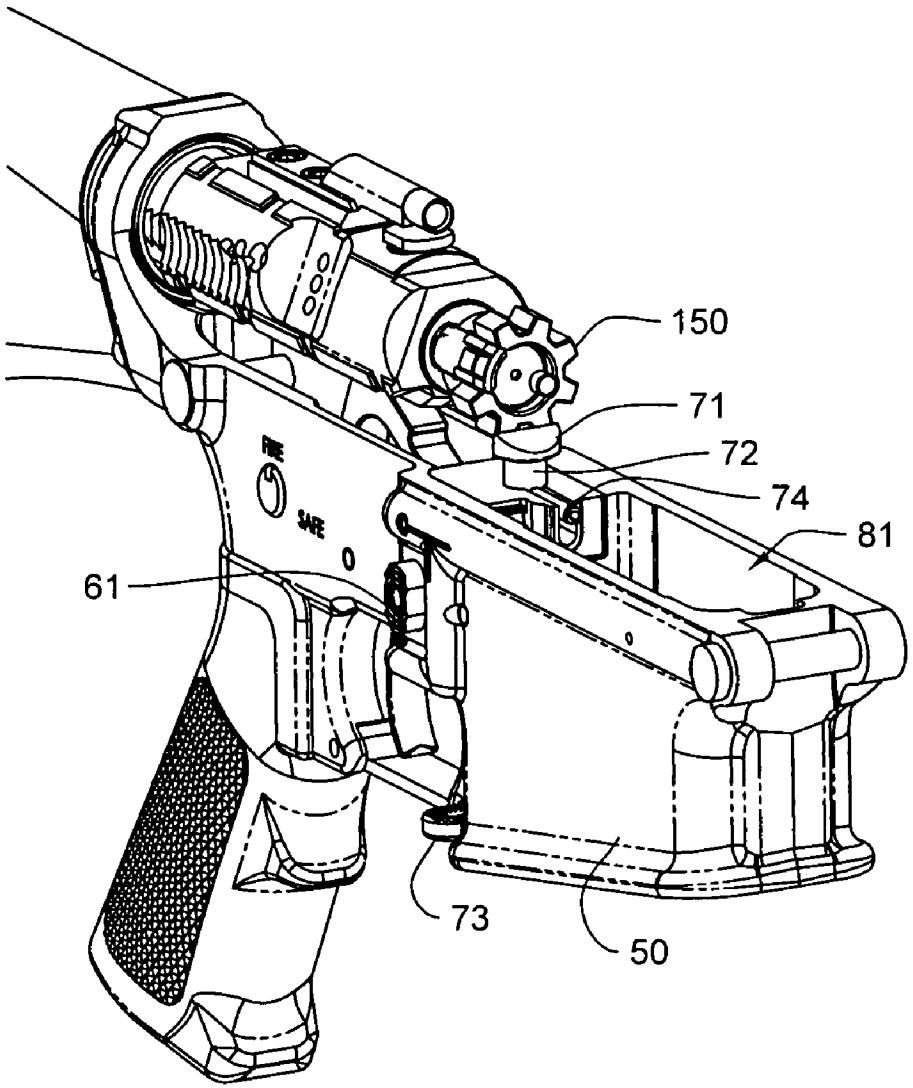
FIG. 10*c* illustrates a partial isometric view of an exemplary embodiment of the receiver with the bolt assembly up against the bolt stop.

FIG. 10*c* illustrates an isometric view of the embodiment depicted in FIG. 10*b*, with the bolt assembly 150 in contact with the bolt stop 71. Thus, the forward movement of the bolt assembly 150 is interrupted by contact with the bolt stop 71 so that the bolt assembly 150 is between the recoiled position and the battery position. The cartridge follower still exerts an upward force upon the bolt stop pin 74 and the compressed operation spring still exerts a forward force on the bolt assembly 150.

As discussed above, after the last cartridge has been fired, the empty tabbed magazine 100 must be removed before the loaded tabbed magazine 100 can be inserted. As discussed above, depressing the magazine release button 61 disengages the magazine catch 63 so that the tabbed magazine 100 can be removed. In an exemplary embodiment, the pressing of the magazine release button 61 causes the tabbed magazine 100 to drop out of the receiver well 81. The tabbed magazine can drop free because the tab is not used to retain the magazine. Thus, the tabbed magazine 100 will be directed out of the receiver well by the force of gravity and the force exerted on the bolt stop pin 74 by the cartridge follower. Thus, in an exemplary embodiment, depressing the magazine release button 61 will cause the empty tabbed magazine 100 to be ejected from the receiver well 81. In an alternative embodiment, a dual-featured magazine can be ejected from the receiver well 81 in a similar manner.

Once the empty tabbed magazine 100 has been removed from the receiver well 81, the loaded tabbed magazine 100 can be inserted. After inserting the loaded tabbed magazine 100, the bolt assembly 150, which presses against the bolt stop 71, can be moved toward the battery position.

To allow the bolt assembly 150 to move to the battery position, the bolt stop 71 can be moved downward out of the blocking position. FIG. 10*c* illustrates an exemplary embodiment of the bolt stop button 73 connected to the bolt stop 71 via the bolt stop member 72, with the bolt stop 71 in the blocking position. As depicted, the bolt stop 71 can be moved downward by exerting a downward force on the bolt stop button 73. The downward movement of the bolt stop button 73 will cause a resultant downward movement of the bolt stop 71 because the bolt stop member 72 connects the bolt stop button 73 to the bolt stop 71. Thus, the bolt stop button 73 can release the bolt assembly 150 so that the bolt assembly 150 can move to the battery position and in the process the bolt assembly 150 can strip a cartridge from the tabbed magazine 100.

In an exemplary embodiment, a firearm 5 includes a receiver 50 with a receiver well 81 having a receiver slot 82, an ambidextrous magazine release button 61, and an ambidextrous bolt stop button 73. In such a receiver, a tabbed magazine 100 can be inserted directly into the receiver well 81 without the need to rotate the tabbed magazine 100. Additionally, after firing the last cartridge in the tabbed magazine 100, the empty tabbed magazine 100 can be ejected from the receiver well 81 by pressing on the ambidextrous magazine release button 61 without the need to rock the tabbed magazine out of the receiver well 81. After ejecting the empty tabbed magazine 100 and inserting a loaded tabbed magazine 100, the ambidextrous bolt stop button 73 can be actuated so as to allow the bolt assembly 150 to return to the battery position, stripping a cartridge from the tabbed magazine 100 in the process. Thus, in an exemplary embodiment, the firearm 5 is suited for rapid tabbed magazine exchange and is further suited for use in either hand (i.e. is suited for ambidextrous use while preserving the ability to rapidly exchange a empty tabbed magazine 100 for a loaded tabbed magazine 100).

The present invention has been described in terms of preferred and exemplary embodiments thereof. Numerous other embodiments, modifications and variations within the scope and spirit of the appended claims will occur to persons of ordinary skill in the art from a review of this disclosure.

I claim:

1. A firearm having a receiver configured to receive a tabbed magazine, comprising:

a receiver well configured to control movement of the tabbed magazine when the tabbed magazine is inserted into the receiver well;

a slot in the receiver well, wherein the slot is configured to receive a tab on the tabbed magazine when the tabbed magazine is inserted into the receiver well; and a magazine catch comprising a curvilinear surface and an angular notch, the curvilinear surface configured to prevent interference of the magazine catch with the locking feature during insertion of the magazine, wherein the magazine catch is configured to rotate as the tabbed magazine is being inserted and the angular notch is configured to engage a locking feature on the tabbed magazine when the tabbed magazine is fully inserted into the receiver well.

2. The firearm of claim 1, further comprising a receiver stop, the receiver stop configured to prevent over insertion of the tabbed magazine.

3. The firearm of claim 2, wherein the receiver stop, the magazine catch, and the receiver well hold the magazine in place.

4. The firearm of claim 1, wherein the receiver well includes a rib for engaging the tabbed magazine, the rib configured to control movement of the tabbed magazine when the tabbed magazine is inserted into the receiver well.

5. The firearm of claim 1, wherein the receiver well includes a chamfer configured to aid insertion of the tabbed magazine.

6. The firearm of claim 1, further comprising a magazine release button, and wherein the receiver comprises a right side and a left side, and wherein the magazine release button is accessible from either the right or left side of the receiver.

7. The firearm of claim 1, further comprising a bolt stop button, and wherein the receiver comprises a right side and a left side, and wherein the bolt stop button is accessible from either the right or left side of the receiver.

8. The firearm of claim 6, further comprising a bolt stop button, and wherein the bolt stop button is accessible from either the right or left side of the receiver.

9. The firearm of claim 1, wherein the magazine catch is rotatably mounted to the receiver and the translation of the magazine release button causes the magazine catch to rotate.

10. The firearm of claim 1, further comprising:

an ambidextrous magazine release button, the magazine release button configured for use by the trigger finger of the user; and an ambidextrous bolt stop button, the bolt stop button configured for use by the trigger finger of the user.

11. A firearm having a receiver configured for one hand removal of a tabbed magazine, the receiver comprising:

a receiver well configured to control movement of the tabbed magazine when the tabbed magazine is inserted into the receiver well;

a slot in the receiver well, the slot configured to receive a tab on the tabbed magazine; and a magazine catch having an engaged position and a disengaged position, the magazine catch comprising a curvilinear surface and an angular notch, the curvilinear surface configured to prevent interference of the magazine catch with the locking feature during insertion of the magazine, the magazine catch configured to rotate as the tabbed magazine is being inserted and the angular notch is configured to engage a locking feature in a rib of the tabbed magazine when the tabbed magazine is fully inserted, wherein moving the magazine catch from the engaged position toward the disengaged position causes the magazine catch to disengage the locking feature so that the tabbed magazine can drop out of the receiver well.

12. The firearm of claim 11, wherein the receiver well includes a rib for use in controlling movement of the tabbed magazine when the tabbed magazine is inserted into the receiver well.

13. The firearm of claim 11, wherein the slot is positioned on an opposite side of the receiver well compared to the magazine catch.

14. The firearm of claim 11, wherein a magazine release button is connected to the magazine catch so that pressing the magazine release button causes the magazine catch to move from the engaged to the disengaged position.

15. The firearm of claim 11, wherein the receiver is configured so that a magazine follower in the tabbed magazine pushes the tabbed magazine out of the receiver well when the magazine catch moves to a disengaged position.

* * * * *